US006116723A

United States Patent [19]

Childers

[11] Patent Number: 6,116,723

[45] Date of Patent: Sep. 12, 2000

[54] LOW COST PRESSURIZABLE INK CONTAINER

[75] Inventor: Winthrop D. Childers, San Diego, Calif.

[73] Assignee: Hewlett-Packard, Palo Alto, Calif.

[21] Appl. No.: 09/036,994

[22] Filed: Mar. 9, 1998

[51] Int. Cl.[7] ..... B41J 2/175

[52] U.S. Cl. ..... 347/85; 347/87

[58] Field of Search ..... 347/84, 85, 86, 347/87; 222/400.8

[56] References Cited

U.S. PATENT DOCUMENTS

| | | | |
|---|---|---|---|
| 4,095,727 | 6/1978 | Dorsch | 222/400.8 |
| 4,342,041 | 7/1982 | Kasugayama | 347/85 |
| 4,422,084 | 12/1983 | Saito | 347/7 |
| 4,432,005 | 2/1984 | Duffield et al. | 347/86 |
| 4,558,326 | 12/1985 | Kimura et al. | 346/140 |
| 4,568,954 | 2/1986 | Rosback | 347/86 |
| 4,604,633 | 8/1986 | Kimura | 347/7 |
| 4,714,937 | 12/1987 | Kaplinsky | 347/86 |
| 4,977,413 | 12/1990 | Yamanaka | 347/7 |
| 5,307,091 | 4/1994 | DeCoste, Jr. | 347/86 |
| 5,650,811 | 7/1997 | Seccombe et al. | 347/85 |
| 5,872,584 | 2/1999 | Hauck et al. | 347/7 |

FOREIGN PATENT DOCUMENTS

| | | | |
|---|---|---|---|
| 0921005A | 6/1999 | European Pat. Off. . | |
| 5213372A | 8/1993 | Japan | B65D 77/06 |
| WO 98/55322 | 12/1998 | WIPO . | |

OTHER PUBLICATIONS

European Search Report mailed Oct. 10, 1999 re: European application 98 11 8669.

Patent Abstracts of Japan, vol. 016, No. 471 (M–1318), Sep. 30, 1992, re: Publication JP 04168053 (Matsushita Electric Ind Co Ltd), Jun. 16, 1992, of Application JP 02295794.

Patent Abstracts of Japan, vol. 018, No. 438 (M–1656), Aug. 16, 1994, re: Publication JP 06 134999 (Sharp Corp), May 17, 1994, of Application JP 04285614.

*Primary Examiner*—N. Le
*Assistant Examiner*—Anh T. N. Vo
*Attorney, Agent, or Firm*—Manuel Quiogue

[57] ABSTRACT

An ink delivery system for providing pressurized ink to an ink jet printing system. The ink delivery system includes a collapsible ink reservoir containing ink, a pressure volume for applying pressure to the collapsible ink reservoir, a gas inlet into the pressure volume, a one-way valve for allowing gas flow into the pressure volume, a pressure source for providing pressurizing gas to the gas inlet, and a relief valve for limiting the pressure of the pressurizing gas.

22 Claims, 6 Drawing Sheets

LOW COST PRESSURIZABLE INK CONTAINER

BACKGROUND OF THE INVENTION

The disclosed invention relates to ink jet printing systems that employ replaceable consumable parts including ink cartridges, and more particularly to pressurized ink delivery systems.

The art of ink jet printing is relatively well developed. Commercial products such as computer printers, graphics plotters, and facsimile machines have been implemented with ink jet technology for producing printed media. Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Some known printers utilize a pressurized ink source that provides pressurized ink to the printhead, for example in printers that make use of an ink container that is separately replaceable from the printhead and wherein pressurized ink reduces or eliminates the effects of dynamic pressure drops in the ink delivery path.

A consideration with known implementations of a pressurized ink source include the need for a constant pressure source or a continuous pressure source that maintains pressure above a minimum pressure, which tends to be expensive and complex and results in an inflexible ink delivery design.

SUMMARY OF THE INVENTION

It would therefore be an advantage to provide an inexpensive pressurized ink delivery system.

A further advantage would be to provide a pressurized ink delivery system that does not utilize an expensive and/or complex pressure source.

Another advantage would be to provide a pressurized ink container that does not require pressurization with a continuous pressure source.

The foregoing and other advantages are provided by the invention in an ink container that includes a collapsible ink reservoir containing ink, a pressure volume for applying pressure to the collapsible ink reservoir, a gas inlet into the pressure volume, and a one-way valve for allowing gas flow into the pressure volume. In accordance with a further aspect of the invention, a non-constant pressure source provides pressurizing gas to the gas inlet and a relief valve limits the pressure of the pressurizing gas.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
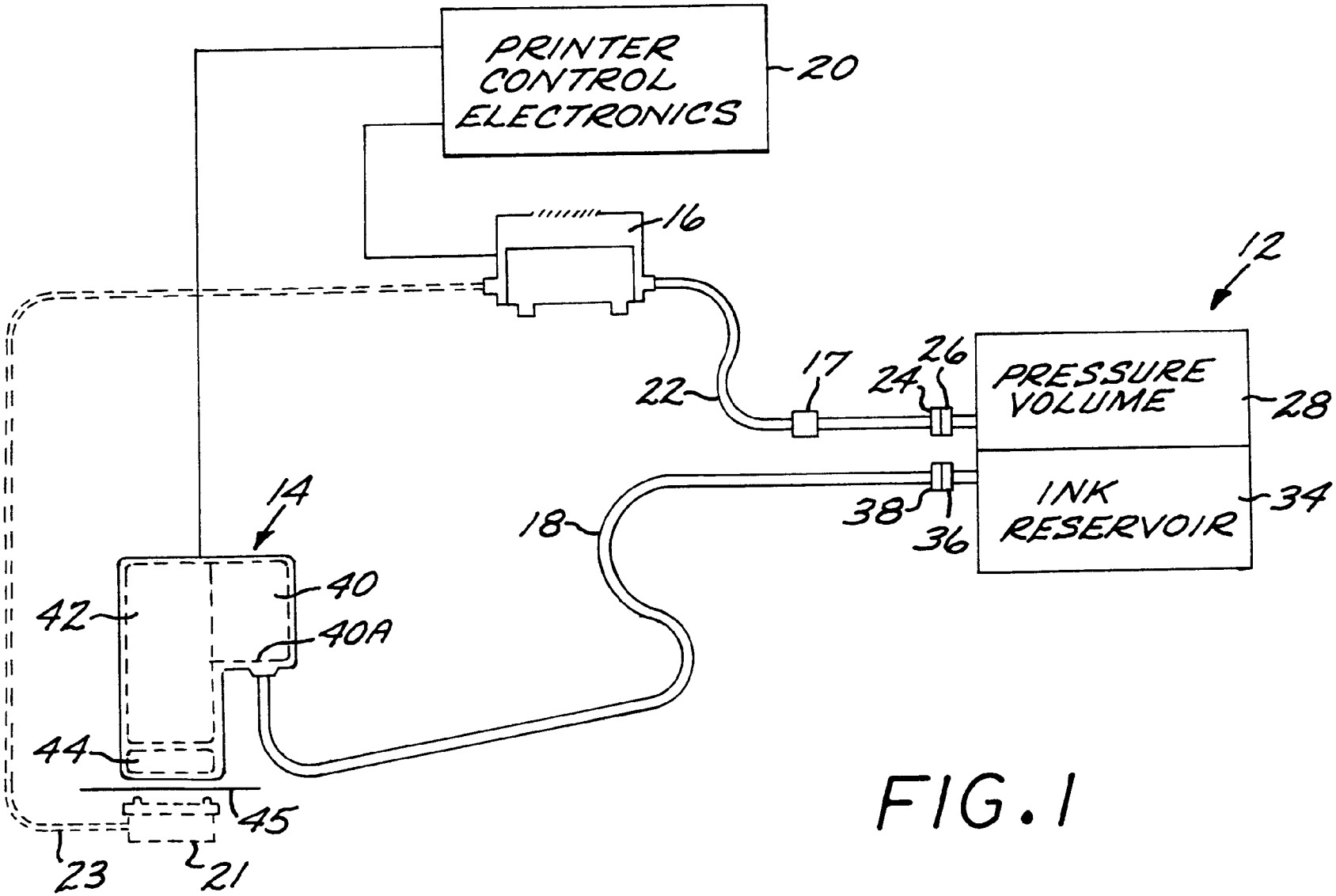
FIG. 1 is a schematic representation of a printing system that employs the ink container and ink delivery system of the invention.

In the following detailed description and in the several figures of the drawing, like elements are identified with like reference numerals.

Referring now to FIG. 1, set forth therein is a schematic block diagram of an ink jet printing system in which the invention can be employed. The invention generally contemplates a pressurized ink delivery system that utilizes a non-constant pressure source, including for example a source that provides intermittent pressure, and further contemplates a pressurizable ink container that can be utilized with a non-constant source of pressure.

The ink jet printing system of FIG. 1 includes an ink container 12 that is pressurized by a pressure source 16 so as to provide pressurized ink to an ink jet printhead 14 that selectively deposits ink on print media 45. More particularly, the pressure source 16 is controlled by printer control electronics 20 and provides pressurized gas such as air to the ink container 12 via a pressure conduit 22 which is coupled to a gas outlet 24 that in turn is connected to a gas inlet 26 of the ink container 12. The gas inlet 26 is coupled to a pressure volume 28 that comprises for example a pressure vessel.

The pressure volume 28 applies pressure to an ink reservoir 34 that stores ink and is fluidically coupled to fluid outlet 36 which in turn is coupled to a fluid inlet disposed at one end of a fluid conduit 18. Another end of the fluid conduit 18 is coupled to the printhead 14. By way of illustrative example, the ink reservoir 34 comprises a collapsible bag that is disposed within the pressure volume 28 and transmits pressure within the pressure volume 28 to the ink within the ink reservoir 34.

The ink jet printhead 14 includes a regulator portion 40, an internal ink reservoir 42, and an ejector portion 44. The regulator 40 regulates or controls fluid pressure within the internal reservoir, and in one embodiment includes a valve 40*a* that is connected to the fluid conduit 18. The regulator 40 opens and closes the valve 40*a* in response to changes in the internal reservoir 42 to maintain a proper gauge pressure in the internal reservoir 42. The internal ink reservoir 42 is fluidically coupled to the ejector portion 44 which selectively deposits ink on print media 45 pursuant to control by the printer electronics 20.

The ink jet printhead 14 requires a minimum ink operating pressure $P_{om}$ at the fluid outlet 36 in order to achieve maximum printing speed, and one aspect of the invention contemplates maintaining a continual pressure at the fluid outlet, at or above the minimum operating pressure $P_{om}$, by use of a one-way valve that allows only one-way gas flow into the pressure volume 28. Another aspect of the invention contemplates that the pressure source 16 comprises a non-constant pressure source (e.g., one that provides pressure pulses), and a pressure relief valve 17 is disposed in the pressure conduit 22 between the pressure source 16 and the pressure volume 28 to avoid over pressurizing. The pressure source 16 in conjunction with the pressure relief valve 17 would thus provide a pressure in the range between $P_{min}$ and $P_{max}$. By way of illustrative example, the pressure relief valve comprises a duck bill valve or a poppet valve.

The one-way valve has a forward direction into the pressure volume such that it allows a flow of gas from the pressure source 16 to the pressure volume 28 when the pressure at the gas inlet 26 is equal to or greater than the valve opening pressure $P_{valve}$, wherein $P_{valve}$ is less than $P_{max}$ which is defined by the pressure relief valve 17 and which is selected to be greater than or equal to the minimum ink operating pressure $P_{om}$.

In an implementation wherein the pressure source provides pressure intermittently, the pump alternates between a pressure cycle and a refresh cycle. During pressure cycle, the pressure is positive at the gas inlet 26, and during a refresh cycle the pressure at the gas inlet 26 can become negative. Since that valve opens only when the pressure at the gas inlet 26 is equal to or greater than either the $P_{valve}$ or the internal pressure of the pressure volume, whichever is greater, pressure is maintained in the pressure volume when the pressure at the gas inlet 26 is less than $P_{valve}$ or the internal pressure of the pressure volume, whichever is greater.

Examples of suitable variable pressure sources include variable volume chamber pumps (e.g., diaphragm pumps and bellows type pumps) and peristaltic pumps. Many ink jet printers include an ink jet primer pump comprised of a variable volume chamber pump or a peristaltic pump, and such ink jet primer pump is advantageously utilized as the pressure source 16, which avoids the cost and complexity of providing a separate apparatus for pressurizing the ink container. In such implementation, a printhead engaging cap 21 is fluidically coupled to the pressure source 16 by a vacuum line 23, as shown in broken lines in FIG. 1. The printhead engaging cap 21 is brought into engagement with the printhead in accordance with conventional techniques.

Figure 2:
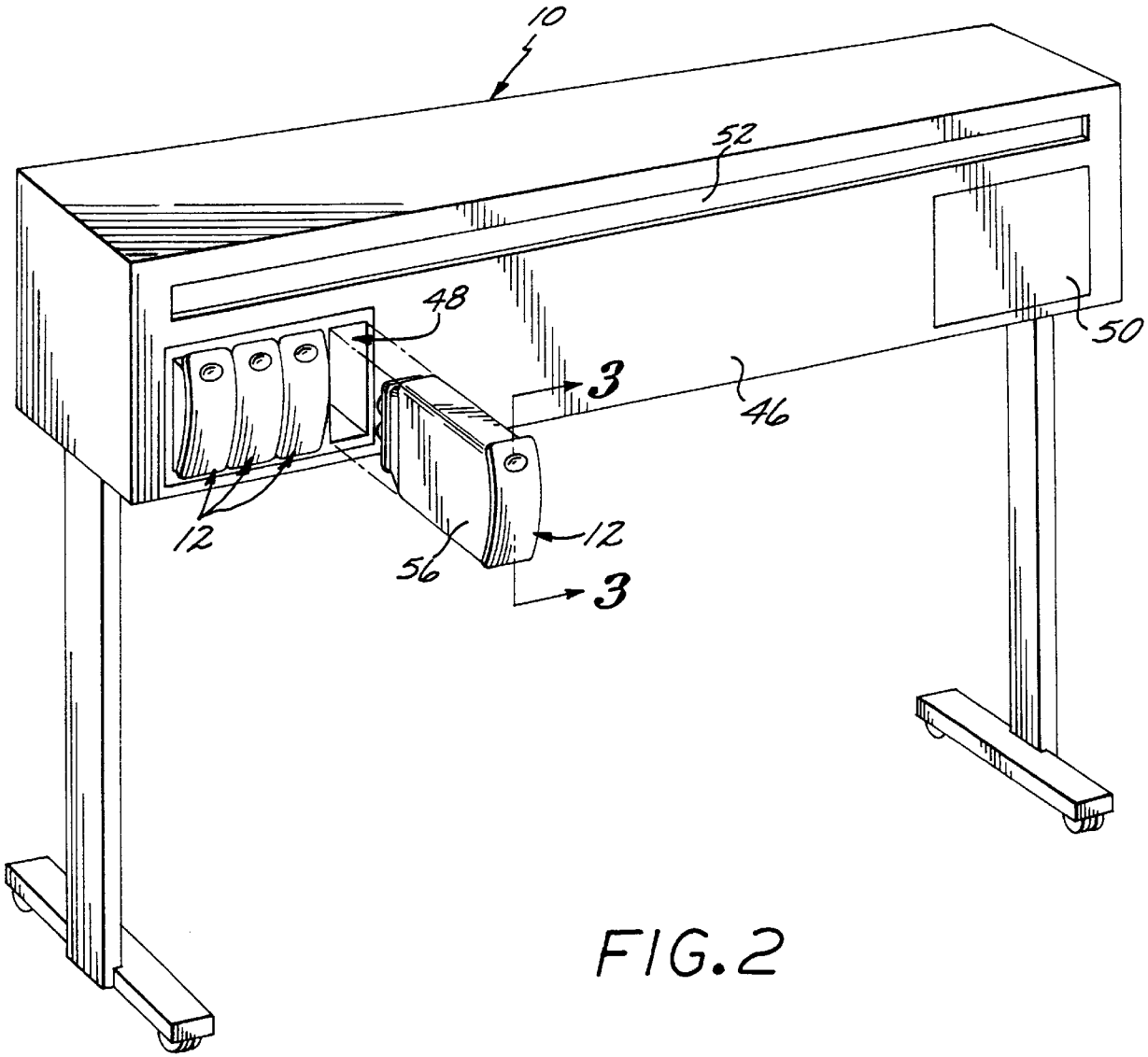
FIG. 2 is simplified isometric view of an implementation of a printing system that employs the ink container and ink delivery system of the invention.

FIG. 2 shows in isometric view an exemplary form of a large format printer/plotter in which the invention can be employed. The printer/plotter includes a printing chassis 46 having a one or more receiving slots 48 in which respective ink containers 12 of the present invention are removably slidably mounted. By way of illustrative example, the embodiment illustrated in FIG. 2 is configured to receive four ink containers 12 with each container 12 containing a different color ink such as cyan, yellow, magenta and black inks. Each of the four inks is provided to respectively associated printheads 14. The printer chassis 46 further includes a control panel for controlling operation of the printer/plotter and a media slot 52 from which print media is ejected.

Figure 4:
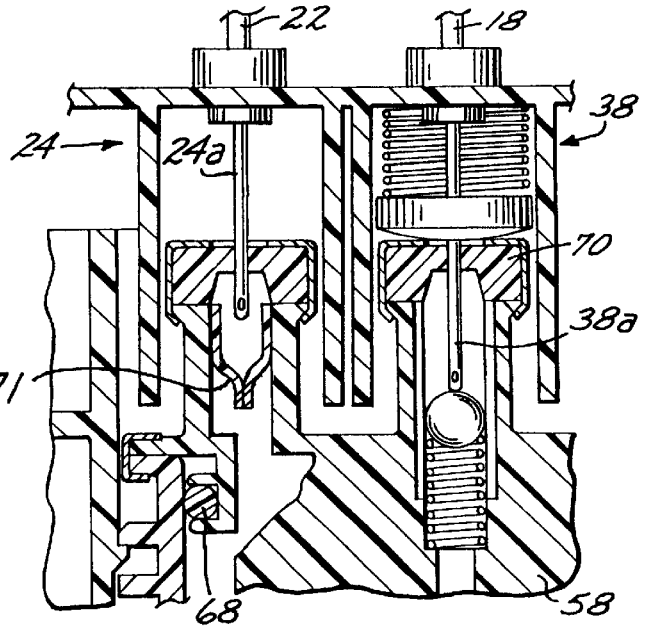
FIG. 4 is a partial cross sectional view illustrating fluid and gas connections to the ink container of FIG. 3.
Figure 3:
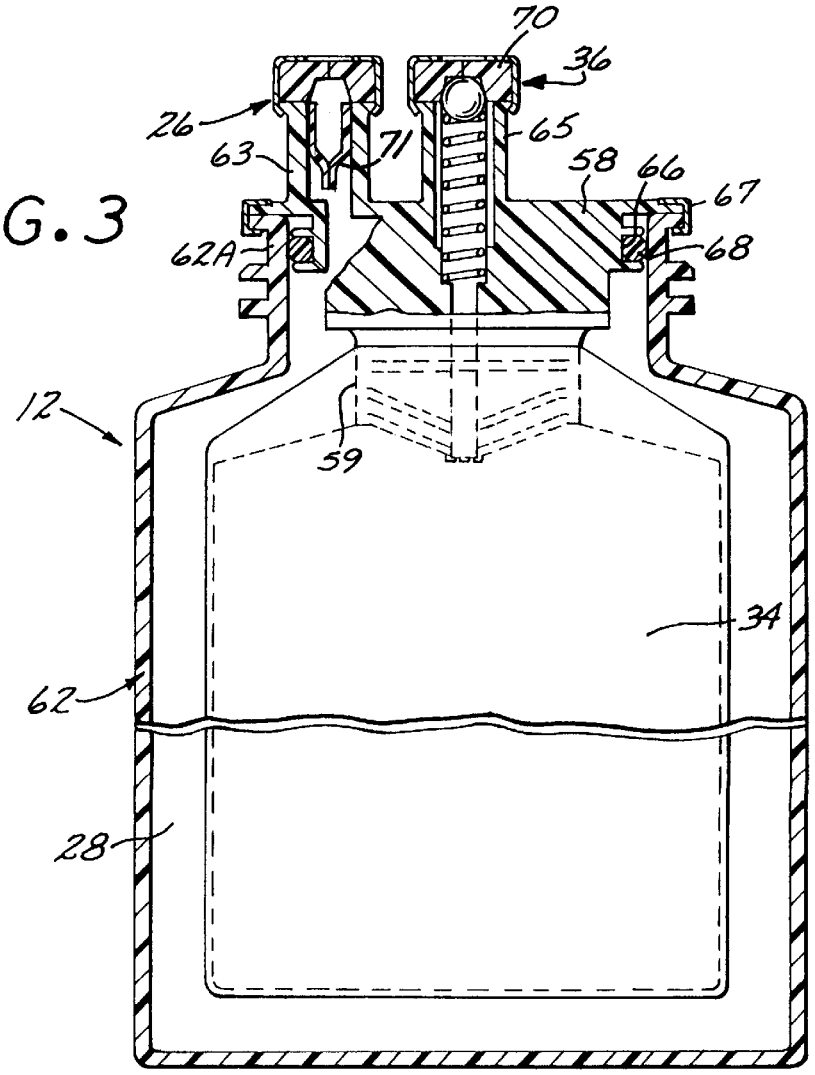
FIG. 3 is a cross-sectional view take through 3—3 of FIG. 2 of an ink container in accordance with the invention.

Referring now to FIGS. 3 and 4, schematically illustrated therein is a specific implementation of the ink container 12 in accordance with the invention. The ink container 12 generally includes a pressure vessel 62, a chassis member 58 attached to a neck region 62A at a leading end of the pressure vessel 62, and the ink reservoir 34 (shown by way of illustrative example as a collapsible ink bag) disposed within the pressure vessel 62. The ink reservoir 34 is sealingly attached to a keel portion 59 of the chassis 58 which seals the interior of the pressure vessel 62 from outside atmosphere while providing for an air inlet port 63 to the interior of the pressure vessel 62 and an ink outlet port 65 for ink contained in the ink reservoir 34. The volume between the outside surface of the ink reservoir 34 and the inside surface of the pressure vessel 62 defines the pressure volume 28. By way of illustrative example, the gas inlet 26 comprises a gas septum and the gas outlet 24 comprises a hollow needle 24*a* inserted in the gas septum, and the fluid outlet 36 comprises a fluid septum 70 and the fluid inlet 38 comprises a hollow needle 38*a* inserted in the fluid septum 70.

By way of illustrative example, the pressure vessel 62 is a relatively rigid bottle shaped enclosure fabricated of polyethylene.

The chassis 58 is secured to the opening of the neck region 62A of the pressure vessel 62, for example by an annular crimp ring 67 that engages a top flange of the pressure vessel 62 and an abutting flange of the chassis member 58. A pressure sealing O-ring 68 suitably captured in a circumferential groove on the chassis 58 engages the inside surface of the neck region 62A of the pressure vessel 62.

The collapsible ink reservoir 34 more particularly comprises a pleated bag, that is formed for example by folding opposed lateral edges of an elongated sheet of bag material such that the opposed lateral edges of the sheet overlap or are brought together, so as to form an elongated cylinder. The lateral edges are sealed together, and pleats are in the resulting structure generally in alignment with the seal of the lateral edges. The bottom or non-feed end of the bag is formed by heat sealing the pleated structure along a seam transverse to the seal of the lateral edges. The top or feed end of the ink reservoir is formed similarly while leaving an opening for the bag to be sealingly attached to the keel portion 59 of the chassis 58. By way of specific example, the ink reservoir bag is sealingly attached to keel portion 59 by heat staking.

In accordance with the invention, the ink container 12 includes a one-way valve 71 disposed at an interior end of the air inlet 63, which allows the pressure source 16 (FIG. 1) to be a non-constant pressure source. In particular, the one-way valve 71 allows pressurization when the input pressure to the ink container 12 slightly exceeds the internal pressure within the ink container 12, and prevents backflow when the input pressure to the ink container 12 is equal to or less than the internal pressure within the ink container. The maximum input pressure to the ink container 12 is controlled by the pressure relief valve 17 (FIG. 1), and the pressure source 16 is selected to provide sufficient pressure and volume to pressurize the container 12 to the pressure defined by the pressure relief valve 17 and to replenish pressure dissipated by leakage and ink usage. In this manner, the pressure within the ink container 12 is maintained at close to the pressure defined by the pressure relief valve 17 (FIG. 1).

If the pressure relief valve 17 is not implemented, then the pressure within the ink container 12 would be maintained at close to the maximum pressure provided by the non-constant pressure source 16 (FIG. 1).

In accordance with a specific aspect of the invention, the pressure source 16 of FIG. 1 comprises a priming pump (e.g., a vacuum pump) as utilized in commercially available ink jet printers, wherein the pressure is provided by the pressure side of the priming pump. Use of a priming pump as a pressure source avoids the need for the separate pressure source, and makes use of proven reliable apparatus.

Figure 5:
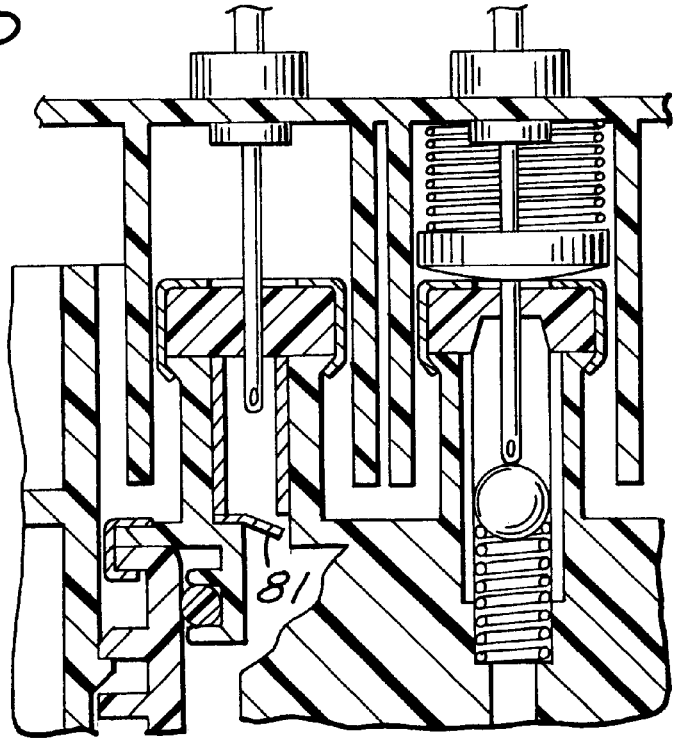
FIG. 5 is a partial cross section view illustrating a further embodiment of a one-way valve of the ink container of the invention.
Figure 6:
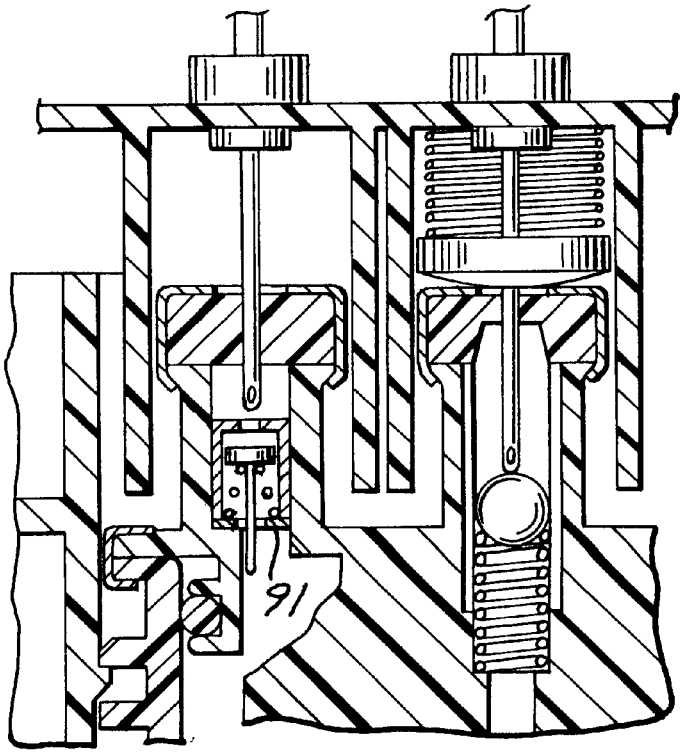
FIG. 6 is a partial cross-sectional view illustrating another embodiment of a one-way valve of the ink container of the invention.

By way of illustrative example, the one-way valve comprises a duck-bill valve as illustrated in FIGS. 3 and 4, or a flapper valve 81 as illustrated in FIG. 5 that is partial view of the chassis 58. As yet a further alternative, the one-way valve of the ink container 12 comprises a poppet valve 91 as illustrated in FIG. 6 which is another partial view of the chassis 58.

Figure 7A:
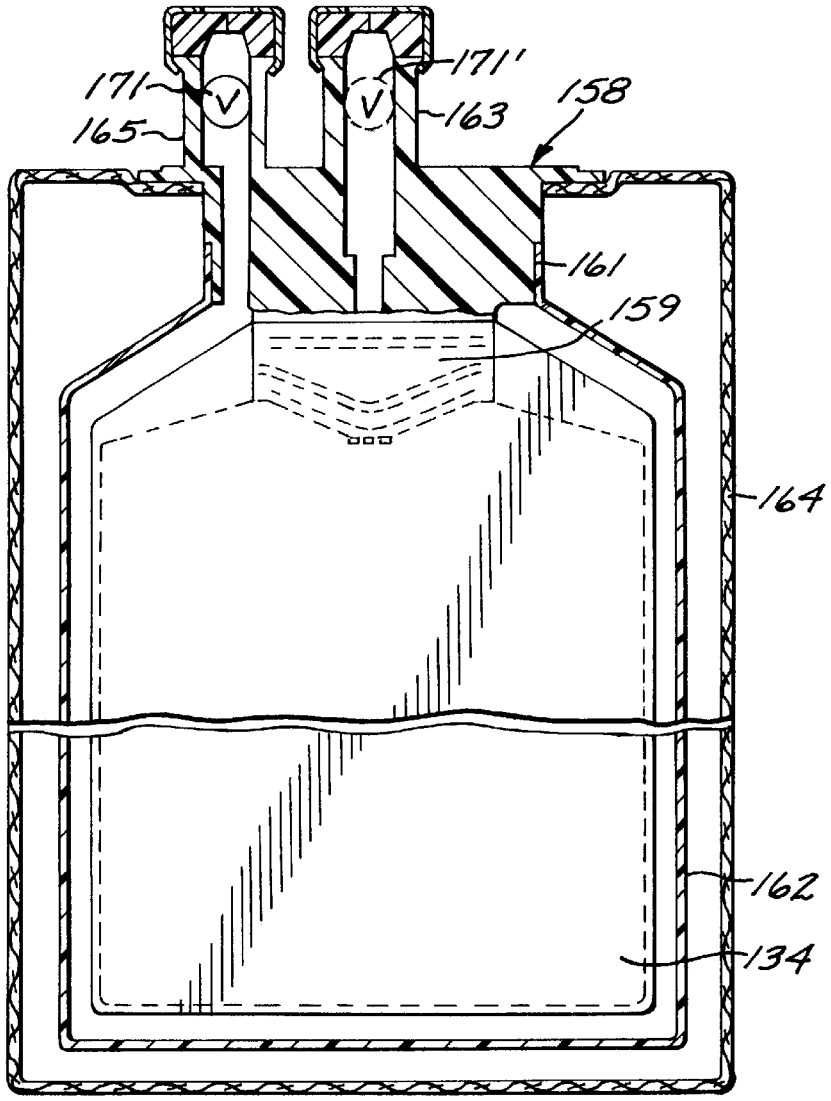
FIG. 7A is a cross-sectional view of a further ink container in accordance with the invention.
Figure 7B:
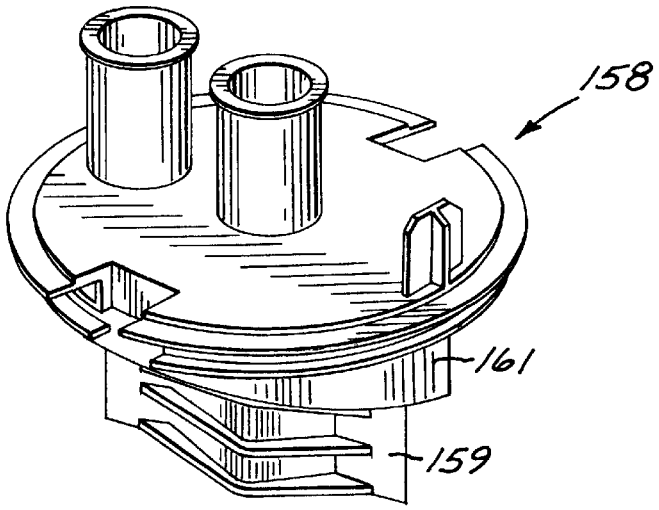
FIG. 7B is a schematic illustration of the chassis of the ink container of FIG. 7A.

FIGS. 7A and 7B schematically illustrate a further ink container in accordance with the invention that includes a collapsible inner bag 134 disposed within a collapsible outer bag 162. The collapsible inner bag 134 is sealingly attached to an inner keel portion 159 of a chassis 158 that is substantially similar to the chassis 58 of FIG. 3 and which seals the interior of the collapsible inner bag 134 from outside atmosphere while providing for a first fluid port 163 to the interior of the collapsible inner bag 134. The collapsible outer bag 162 is sealingly attached to an outer keel portion 161 of the chassis 158 which seals the interior of the collapsible outer bag 162 from outside atmosphere while providing for a second fluid port 165 to the interior of the collapsible outer bag 162. The inner keel portion 159 is axially lower than the outer keel portion 161 (as oriented in FIG. 7), and has a smaller periphery than the outer keel portion 161, such that the inner keel portion 159 is contained within a downward projection of the periphery of the outer keel portion 161 and is in the interior of the collapsible outer bag 162. The chassis 158 is secured in an opening in a housing 164 such as a cardboard box that encloses the collapsible bags 134, 162 and is provided for ease of handling.

In one embodiment, the pressure volume 28 is formed between the collapsible inner bag 134 and the collapsible outer bag 162, and ink is contained in the collapsible inner bag 134. In such embodiment, the first port 163 comprises an ink outlet port and the second port 165 comprises an inlet port for pressurizing gas, and a one-way valve 171 is disposed in the second port 165.

In a further embodiment, the pressure volume 28 is formed by the interior of the collapsible inner bag 134, and ink is contained in the region between the collapsible inner bag 134 and the collapsible outer bag 162. In that embodiment, the first port 163 comprises an inlet port for pressurizing gas and the second port 165 comprises an ink outlet port, and a one-way valve 171' (shown in broken lines) is disposed in the first port 163.

The ink container of FIGS. 7A and 7B is assembled, for example, by first heat sealing a first film bag to the inner keel 159, and then heat sealing a second film bag to the outer keel 161, such that the second film bag surrounds the first film bag. The first film bag and the second film can be pleated bags. Alternatively, the collapsible inner bag 134 is formed by sealing a first pair of opposing film sheets around their periphery and around the inner keel 159, and the collapsible outer bag 162 is formed by sealing a second pair of opposing film sheets around their periphery and around the outer keel 161. The ink container of FIGS. 7A and 7B can assembled at low cost, and accordingly lowers the operational cost of the printing system with which it is used.

Figure 8:
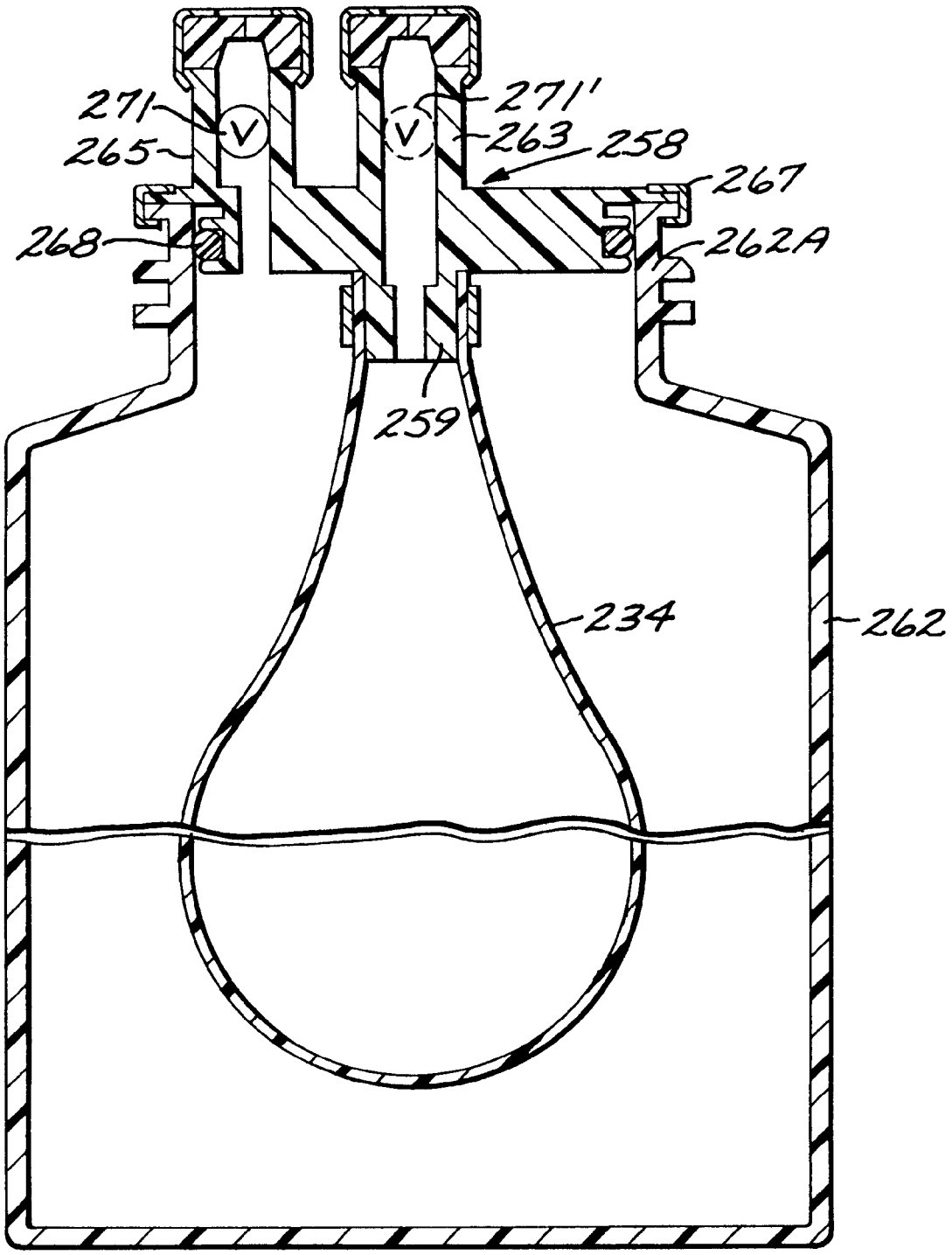
FIG. 8 is a cross-sectional view of another ink container in accordance with the invention.

FIG. 8 schematically illustrates another ink container in accordance with the invention that includes a resilient bladder 234 disposed within a relatively rigid pressure vessel 262. The use of a resilient bladder, formed for example of rubber, advantageously allows the use of any shape of pressure vessel. A chassis member 258 substantially similar to the chassis 58 of FIG. 3 is attached to a neck region 262A at a leading end of the rigid pressure vessel 262, and the resilient bladder 234 is sealingly attached to a tube 259 of the chassis 258 which seals the interior of the rigid pressure vessel 262 and the interior of the resilient bladder 234 from outside atmosphere, while providing for a first fluid port 263 to the interior of the resilient bladder 234 and a second fluid port 265 to the interior of the pressure vessel 262.

The chassis 258 is secured to the opening of the neck region 262A of the pressure vessel 262, for example by an annular crimp ring 267 that engages a top flange of the pressure vessel 262 and an abutting flange of the chassis member 258. A pressure sealing O-ring 268 suitably captured in a circumferential groove on the chassis 258 engages the inside surface of the neck region 262A of the pressure vessel 262.

In one embodiment, the pressure volume 28 is formed between the resilient bladder 234 and the pressure vessel 262, and ink is contained in the resilient bladder 234. In such embodiment, the first port 263 comprises an ink outlet port and the second port 265 comprises an inlet port for pressurizing gas, and a one-way valve 271 is disposed in the second port 265.

In a further embodiment, the pressure volume 28 is formed by the interior of the resilient bladder 234, and ink is contained in the region between the resilient bladder 234 and the pressure vessel 262. In that embodiment, the first port 263 comprises an inlet port for pressurizing gas and the second port 265 comprises an ink outlet port, and a one-way valve 271' (shown in broken lines) is disposed in the first port 263.

The foregoing has been a disclosure of a low cost ink delivery system for ink jet printers that advantageously provides for design flexibility and utilizes a non-constant pressure source.

Although the foregoing has been a description and illustration of specific embodiments of the invention, various modifications and changes thereto can be made by persons skilled in the art without departing from the scope and spirit of the invention as defined by the following claims.

What is claimed is:

1. An ink delivery apparatus for providing pressurized ink to an ink jet printing system, comprising:

a collapsible ink reservoir containing ink;

a pressurizable container receiving non-constant pressurizing gas and for containing pressurized gas that applies pressure to said collapsible ink reservoir such that said ink in said collapsible ink reservoir is pressurized;

a gas inlet connected to said pressurizable container for conveying said pressurizing gas to said pressurizable container;

a one-way valve in said pressurizable container for allowing said non-constant pressurizing gas to flow into said pressurizable container; and a fluid outlet connected to said collapsible ink reservoir for conveying said pressurized ink to the ink jet printing system.

2. The ink delivery apparatus of claim 1 wherein said pressurizable container comprises a pressure vessel, and wherein said collapsible ink reservoir comprises a collapsible bag disposed within said pressure vessel.

3. The ink delivery apparatus of claim 1 wherein said pressurizable container comprises a pressure vessel, and wherein said ink reservoir comprises a resilient bladder disposed within said pressure vessel.

4. The ink delivery apparatus of claim 1 wherein said pressurizable container comprises a collapsible outer bag, and wherein said ink reservoir comprises a collapsible inner bag disposed within said collapsible outer bag.

5. The ink delivery apparatus of claim 1 wherein said ink reservoir comprises a collapsible outer bag, and wherein said pressurizable container comprises a collapsible inner bag disposed within the collapsible outer bag.

6. The ink delivery apparatus of claim 1 further including:

a non-constant pressure source for providing pressurizing gas to said gas inlet; and a relief valve connected to the non-constant pressure source for limiting a pressure of said pressurizing gas that is provided to said gas inlet.

7. The ink delivery system of claim 6 wherein said pressure source comprises a variable volume chamber pump.

8. The ink delivery system of claim 6 wherein said pressure source comprises a peristaltic pump.

9. The ink delivery system of claim 6 wherein said pressure source comprises an ink jet primer vacuum pump.

10. An ink delivery apparatus for an ink jet printing system, the ink delivery apparatus comprising:

an ink container for containing ink and a collapsible bag for containing a pressurized gas in response to a non-constant pressurizing gas from a pump provided to said collapsible bag, said pressurized gas applying pressure to said ink such that said ink is pressurized ink; and one-way valve in said container, one end of said one-way valve connected to said pump and other end connected to said collapsible bag, for maintaining said pressurized gas above a predetermined pressure.

11. The ink delivery apparatus of claim 10 further including a variable chamber pump for providing said non-constant pressure.

12. The ink delivery apparatus of claim 10 further including a peristaltic pump for providing said non-constant pressure.

13. The ink delivery apparatus of claim 10 further including an ink jet primer pump for providing said non-constant pressure.

14. A method of delivering pressurized ink to a printhead, comprising the steps of:

providing a non-constant pressure from a pump to an ink container through one-way valve in said ink container so as to pressurize ink in an ink reservoir, whereby the ink in the ink reservoir is pressurized ink;

maintaining a pressure of the pressurized ink at a pressure that is continually greater than a predetermined pressure; and supplying the pressurized ink from the ink reservoir to the printhead.

15. An ink delivery apparatus for providing ink to an ink jet printing system, comprising:

a collapsible outer bag for receiving pressurizing gas and for containing pressurized gas, a collapsible inner bag disposed within said collapsible outer bag for containing ink that is to be provided to the ink jet printing system, wherein said pressurized gas applies pressure to said collapsible inner bag such that said ink in said collapsible inner bag is pressurized;

a gas inlet connected to said collapsible outer bag for conveying said pressurizing gas into said pressurizable collapsible outer bag;

a fluid outlet connected to said collapsible inner bag for conveying ink from said collapsible inner bag to the ink jet printing system;

a one-way valve in said collapsible outer bag that allows said collapsible outer bag to receive said pressurizing gas at a non-constant pressure and maintains said pressurized gas at a pressure that is above a predetermined pressure.

16. The ink delivery apparatus of claim 15 further comprising:

an ink ejector portion for selectively depositing ink on media; and a regulator portion for receiving ink from said collapsible inner bag via said fluid outlet and providing ink received from said collapsible inner bag to said ink ejector portion.

17. The ink delivery apparatus of claim 15 wherein said collapsible outer bag includes an opening and said collapsible inner bag includes an opening, and further including a chassis sealingly attached to said opening of said collapsible outer bag and to said opening of said collapsible inner bag.

18. The ink delivery apparatus of claim 17 wherein said chassis comprises:

an inner keel attached to the opening of said collapsible inner bag; and an outer keel attached to the opening of said collapsible outer bag.

19. An ink delivery apparatus for providing ink to an ink jet printing system, comprising:

a collapsible inner bag for receiving pressurizing gas and for containing pressurized gas;

a collapsible outer bag enclosing said collapsible inner bag for containing ink that is to be provided to the ink jet printing system, wherein said collapsible inner bag applies pressure to said ink such that said ink is pressurized;

a fluid outlet connected to said collapsible outer bag for conveying ink from said collapsible outer bag to the ink jet printing system;

a gas inlet connected to said collapsible inner bag for conveying pressurizing gas into said collapsible inner bag;

a one-way valve in said collapsible inner bag that allows said collapsible inner bag to receive said pressurizing gas at a non constant pressure and maintains said pressurized gas at a pressure that is above a predetermined pressure.

20. The ink delivery apparatus of claim 19 further comprising:

an ink ejector portion for selectively depositing ink on media; and a regulator portion for receiving ink from said collapsible outer bag via said fluid outlet and providing ink received from said collapsible outer bag to said ink ejector portion.

21. The ink delivery apparatus of claim 19 wherein said collapsible outer bag includes an opening and said collapsible inner bag includes an opening, and further including a chassis sealingly attached to said opening of said collapsible outer bag and to said opening of said collapsible inner bag.

22. The ink delivery apparatus of claim 21 wherein said chassis comprises:

an inner keel attached to the opening of said collapsible inner bag; and an outer keel attached to the opening of said collapsible outer bag.

* * * * *